United States Patent [19]

Stalder et al.

[11] 4,296,814

[45] Oct. 27, 1981

[54] METHOD FOR THERMALLY INSULATING WELLBORES

[75] Inventors: John L. Stalder, Ventura, Calif.; William L. Martin, Ponca City, Okla.

[73] Assignee: Conoco Inc., Ponca City, Okla.

[21] Appl. No.: 170,273

[22] Filed: Jul. 18, 1980

[51] Int. Cl.[3] ..... E21B 43/24

[52] U.S. Cl. ..... 166/303; 166/302

[58] Field of Search ..... 160/302, 303, 314, DIG. 1, 160/57; 252/62

[56] References Cited

U.S. PATENT DOCUMENTS

| | | | |
|---|---|---|---|
| 3,525,399 | 8/1970 | Bayless et al. | 166/303 |
| 3,664,424 | 5/1972 | Penberthy, Jr. et al. | 166/303 |
| 3,718,184 | 2/1973 | Bayless et al. | 166/57 |
| 3,719,601 | 3/1973 | Jacocks | 166/302 X |
| 3,861,469 | 1/1975 | Bayless et al. | 166/303 |
| 4,074,757 | 2/1978 | Felber et al. | 166/294 X |

OTHER PUBLICATIONS

Willhite et al., "Use of an Insulating Fluid for Casing Protection During Steam Insection," *Journal of Petroleum Technology*, Nov. 1967, pp. 1453–1456.

*Primary Examiner*—James A. Leppink
*Assistant Examiner*—George A. Suchfield
*Attorney, Agent, or Firm*—A. Joe Reinert

[57] ABSTRACT

Methods and apparatus for insulating a well bore to reduce heat transfer between fluids flowing through the well bore and surrounding formations wherein a heat activated gel-forming fluid having heat insulating properties when gelled is introduced into the annular space between the well bore and the tubing string contained therein and caused to be gelled.

23 Claims, 2 Drawing Figures

METHOD FOR THERMALLY INSULATING WELLBORES

BACKGROUND OF THE INVENTION

1. Field of the Invention

The present invention relates generally to methods and apparatus for insulating well bores, and more particularly, but not by way of limitation, to methods and apparatus for insulating well bores with heat-activated gel-forming fluids.

2. Description of the Prior Art

It is often desirable and/or necessary to insulate well bores penetrating subterranean formations to reduce heat transfer between the well bores and surrounding formations. Generally, such well bores contain tubing strings extending from the surface to a point within the well bore adjacent the formation to be produced or into which fluids are to be injected. For example, in stimulating the recovery of oil from a heavy oil formation, i.e., a formation containing oil of high viscosity, steam flooding techniques are often utilized wherein steam is injected into the formation by way of one or more injection wells to heat the heavy oil and drive it towards and into one or more producing wells. In such steam stimulation operations, if the injected steam loses heat at a high rate to surrounding formations while flowing through the tubing string in an ejection well bore, the required or desired heat does not reach the formation and/or high energy consumption per barrel of oil produced results. The insulation of well bores to reduce heat transfer between the well bores and surrounding formations is often desirable in other applications such as in wells penetrating frozen strata (permafrost) to prevent melting, geothermal energy recovery wells to prevent the loss of heat from the fluids produced and in conventional wells wherein low strength or heat sensitive materials have been used.

Heretofore, well bores have been insulated by placing an insulating material in the annular space between the well bore and the tubing string disposed therein. For example, U.S. Pat. No. 3,451,479 dated June 24, 1969 to Parker teaches packing the annulus between a well bore and a tubing string with an aqueous solution of a water soluble inorganic salt, such as borax, sodium carbonate, sodium sulfate and mixtures thereof and then injecting a hot fluid through the tubing string into the formation to evaporate water from the solution whereby a substantial coat of the salt in solid form is deposited on the walls of the well bore and tubing string.

U.S. Pat. No. 3,861,469 dated Jan. 21, 1975 to Bayless et al. teaches the thermal insulation of a well bore by boiling a silicate solution in the annular space between the well bore and the tubing string to form a coating of alkali metal silicate foam on the tubing.

Other techniques have been used wherein gel-forming fluids and materials are gelled or solidified in the annuli of well bores to thermally insulate the well bores, but such techniques are generally expensive to carry out and/or the insulating solids produced are expensive or impossible to remove.

In the heretofore used techniques for insulating well bores, packers for providing leak-proof pressure seals between the tubing string and casing must be utilized to isolate the insulating medium introduced into the annulus from the well bore fluids below the packers. Typical such packers include elastomer sealing elements or mechanical sealing means which are often troublesome in high temperature environments and/or expensive to use. Generally, elastomer sealing elements deteriorate at high temperatures resulting in leaks and/or the packers becoming stuck in the well bore. In addition, packers designed for high temperatures are expensive and difficult to place in the well bore.

By the present invention improved methods of thermally insulating a well bore containing a tubing string to reduce heat transfer between the well bore and surrounding formations are provided wherein a heat-activated gel-forming fluid is introduced into and gelled in the annular space between the well bore and a tubing string disposed therein whereby the well bore is insulated. The methods are relatively inexpensive to carry out and the insulating gel produced can be removed from the well bore after use. Apparatus for carrying out the methods are also provided which are inexpensive and easily utilized. The apparatus does not include elastomer sealing members or mechanical seal means thereby obviating the problems associated therewith.

SUMMARY OF THE INVENTION

Methods of thermally insulating well bores containing tubing strings to reduce heat transfer between the well bores and surrounding formations comprising introducing into the annular space between the well bore and the tubing string a heat-activated gel-forming fluid having heat insulating properties when gelled and then causing the gel-forming fluid to be heated whereby it is gelled. Apparatus for carrying out the methods are also provided.

It is, therefore, a general object of the present invention to provide methods and apparatus for thermally insulating well bores.

A further object of the present invention is the provision of methods for insulating well bores which are inexpensive and easily carried out.

Another object of the present invention is the provision of apparatus for insulating a well bore which restricts flow in the annular space between the well bore and the tubing string contained therein without the use of elastomer sealing elements or other means which deteriorate at high temperatures and/or are difficult and expensive to use.

Other and further objects, features and advantages of the present invention will be readily apparent to those skilled in the art upon a reading of the following description of preferred embodiments in conjunction with the accompanying drawings.

DESCRIPTION OF PREFERRED EMBODIMENTS

Figure 1:
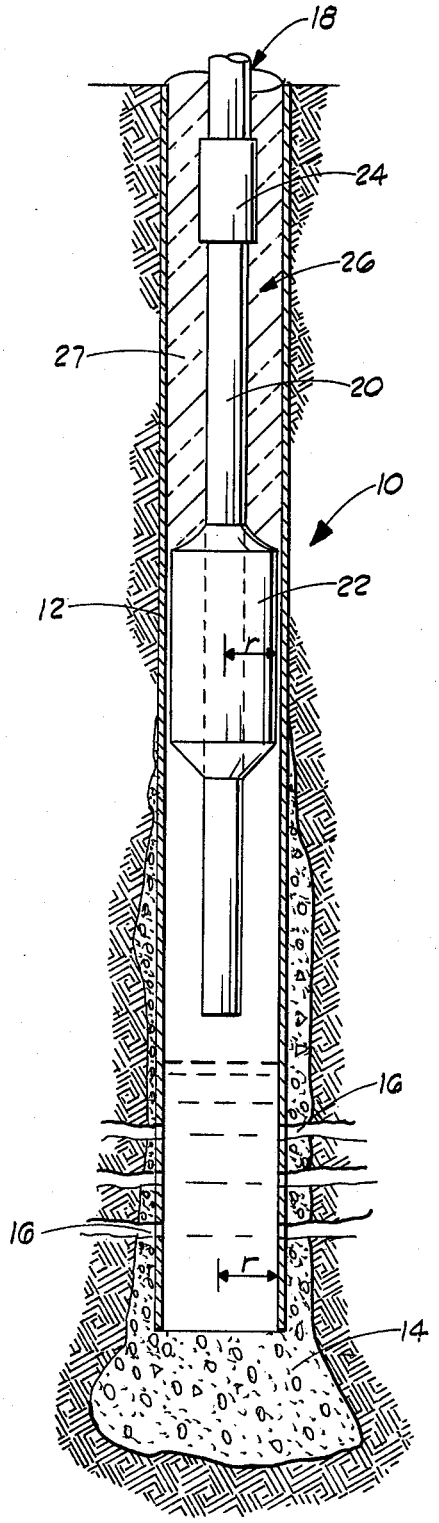
FIG. 1 is a partial vertical cross-sectional view of the lower portion of a well bore insulated in accordance with the methods of this invention and having one form of apparatus of this invention disposed therein.

Referring now to FIG. 1, the lower portion of a well bore is illustrated and generally designated by the numeral 10. Typically, the well bore 10 is lined with casing 12 which is cemented in a conventional manner by cement 14 at the lower end portion thereof. A plurality of perforations 16 are provided in the casing 12 and the cement 14 whereby one or more formations containing desired fluids are communicated with the well bore 10.

As indicated above, the formation or formations penetrated by the well bore 10 and communicated therewith by the perforations 16 can be a heavy oil reservoir into which a hot fluid such as steam is injected to increase the mobility of the heavy oil and drive it towards one or more production wells. On the other hand, the well bore 10 can be a production well penetrating and communicating with one or more formations which naturally exist at high temperatures or in which high temperatures exist due to production stimulation techniques being utilized therein, e.g., steam stimulation, stimulation by combustion of materials within the formations, etc. In these and other applications, it is desirable and often necessary that the well bore 10 be thermally insulated to reduce heat transfer between fluids flowing through the well bore 10 and surrounding formations.

The well bore 10 typically includes a string of tubing 18 suspended therein for conducting fluids produced by the formation or formations penetrated by the well bore to the surface or for conducting fluids injected into such formations from the surface to the formations. The tubing string 18 is comprised of a plurality of threadedly connected tubing sections (not shown), and in accordance with the present invention, a hollow tubular apparatus 20 having at least one enlarged portion 22 provided thereon is threadedly connected to the lowermost tubing section of the tubing string 18 by a conventional threaded connector or collar 24.

The enlarged portion 22 of the apparatus 20 functions to restrict the flow of fluids from the annular space 26 between the tubing string 18 and the sides of the well bore 10, i.e, the inside surfaces of the casing 12, to below the enlarged portion 22. In carrying out the methods of the present invention, a heat activated gel-forming liquid is introduced into the annular space 26 in the well bore 10 in a quantity to fill the annular space 26 from a point just above the enlarged portion 22 of the apparatus 20 to a higher point within the annular space below which it is desired to insulate the well bore. As will be understood, some leakage can occur around the enlarged portion 22 of the apparatus 10, but such leakage does not bring about adverse results to the well bore or formations in communication therewith. Once the heat-activated gel-forming liquid has been placed in the annular space 26 it is caused to be heated whereby it gels to form a semi-solid insulating mass 27 in the well bore 10, i.e., the heat transfer between fluids flowing through the tubing string 18 and hot or cold formations surrounding the well bore 10 is reduced by the mass 27.

While various heat activated gel-forming fluids can be utilized in accordance with the methods of the present invention, particularly preferred are fluids such as liquids selected from the group consisting of polymer solutions, completion fluids, suspensions, and aqueous solutions of water soluble lignosulfonates. Of these, aqueous solutions of lignosulfonates are preferred with aqueous solutions of sodium or ammonium lignosulfonates or mixtures of such lignosulfonates wherein the lignosulfonates are present therein in amounts in the range of from about 5% to about 25% by weight being the most preferred. As described in U.S. Pat. No. 4,074,757 dated Feb. 21, 1978 to Felber et al., and U.S. Pat. No. 3,897,827 dated Aug. 5, 1975 to Felber et al., both of which are incorporated herein by reference, such aqueous solutions of sodium and/or ammonium lignosulfonates form gels when heated to a temperature in the range of from about 300° F. to about 600° F. To lower the temperature range at which gelling occurs, certain salts such as sodium dichromate can be added to the aqueous solutions. Such aqueous solutions have a gel time sufficiently long for their placement in the annular space 26 of the well bore 10 before gelling, and have heat insulation properties upon being gelled.

In order to heat the gel-forming liquid after placement in the annular space 26 of the well bore 10 in accordance with the present invention, hot fluid from the formation or formations penetrated by the well bore 10 and communicated therewith are produced through the hollow interior of the apparatus 20 and through the tubing string 18 connected thereto to the surface whereby the gel-forming liquid is heated by heat transfer from the hot produced fluid to the gel-forming liquid. Alternatively, if the formation or formations penetrated by the well bore 10 do not contain hot fluids, a hot fluid is pumped through the tubing string 18 and through the apparatus 20 connected thereto into the formation or formations communicated with the well bore 10.

The present invention is well suited for insulating injection wells used in steam flooding in that once the heat-activated gel-forming fluid is placed in the annular space 26 of the well bore 10, steam injection into the formation or formations communicated with the well bore 10 by way of the perforations 16 is commenced by flowing steam through the tubing string 18 and the apparatus 20 connected thereto. As the steam gives up heat to the gel-forming liquid, the liquid is gelled and the well bore is insulated.

As shown in FIG. 1, the apparatus 20 of the invention is an elongated hollow member or tubing section which includes an enlarged cylindrical portion 22 thereon. The outside radius r of the enlarged portion 22 of the apparatus 20 is smaller than the inside radius r′ of the casing 12 lining the walls of the well bore 10 by a distance in the range of from about 0.05 to about 0.5 inch. Thus, the enlarged portion 22 of the apparatus 20 restricts the flow of gel-forming liquid in the annular space 26 of the well bore 10, but still can be inserted into the well bore 10 without becoming stuck. While some of the gel-forming fluid utilized may leak around the enlarged portion 22 of the apparatus 20 and enter the lower portion of the well bore 10 as well as the formation or formations communicated therewith, such leakage can be kept to a minimum by displacing the gel-forming fluid down the annulus on top of water or other fluid until it fills the annulus. Hot water or other fluid is then injected down the hollow tubing to immediately begin gelling the gel-forming liquid in the annulus. Once gelled, the fluid in the annulus is fixed in place and the apparatus 20 does not need elastomer sealing members or mechanical seal means which deteriorate at high temperatures or are difficult and expensive to operate.

Figure 2:
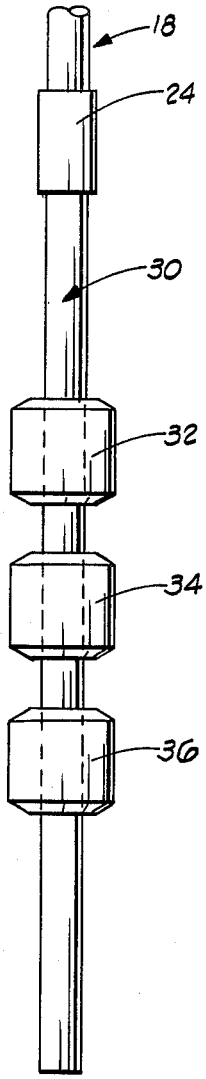
FIG. 2 is a side elevational view of an alternate form of apparatus of the present invention.

Referring to FIG. 2, an alternate embodiment of the apparatus of the present invention is illustrated and generally designated by the numeral 30. The apparatus 30 includes three vertically spaced-apart and enlarged portions 32, 34 and 36 which are of the same radial size and function in the same manner as the single enlarged portion 22 of the apparatus 20. However, by providing spaced-apart enlarged portions 32, 34 and 36, leakage of the gel-forming fluid utilized into the lower portion of the well bore is minimized.

When it is necessary to remove the tubing string 18 and apparatus 20 or 30 connected thereto, the gelled insulating mass 27 can first be removed by reverse circulating and/or dissolving it in a suitable solvent or by "washing over" the injection tubing with suitable tools. Also, depending upon the viscosity of the gelled mass, the tubing string and apparatus 20 or 30 connected thereto as well as the gelled mass 27, can simply be pulled out of the well bore 10.

In order to facilitate a clear understanding of the methods and apparatus of this invention, the following examples are given.

EXAMPLE 1

The apparatus 30 described above and illustrated in FIG. 2 having three enlarged portions 32, 34 and 36 of 3.07 inches outside radius, 2 foot-lengths and vertically spaced apart by 8 feet is threadedly connected to the bottom of a $2\frac{7}{8}$ inches outside diameter tubing string having a total length of 3000 feet suspended in a well bore lined with 7 inches outside diameter (3.12 inches inside radius) casing. About 90 barrels of a 15% by weight aqueous sodium lignosulfonate solution are introduced into the annulus above the apparatus 30 and caused to gel by flowing hot water or steam at 300° F. to 600° F. and 1550 psia through the tubing string and into the formation for about 8 hours. The resulting insulating gel extends in the annulus of the well bore from the top of the uppermost enlarged portion 32 of the apparatus 30 upwardly to the surface.

EXAMPLE 2

In the laboratory, various aqueous solutions of ammonium lignosulfonate are prepared and each is placed in a pressure vessel. The pressure vessel is heated to various high temperatures and the gel times, i.e., times required for the solutions to become highly viscous, determined. The results of these tests are given in Table I below.

TABLE I

GELLATION TIMES FOR VARIOUS AQUEOUS LIGNOSULFONATE SOLUTIONS AT VARIOUS TEMPERATURES

| Quantity of Ammonium Lignosulfonate in Solution, % by Weight | Temperature, °F. | Gellation Time, Hrs. |
|---|---|---|
| 15 | 316 | 116 |
| 15 | 320 | 76 to 92 |
| 12 | 320 | 76 to 92 |
| 15 | 318 | 85 to 148 |
| 12 | 318 | 85 to 148 |
| 8 | 318 | 85 to 148 |
| 15 | 378 | 10 to 22 |
| 12 | 378 | 9 |
| 15 | 380 | 13 |
| 12 | 380 | 13 |
| 10 | 380 | 19 |
| 15 | 399 | 6.2 |

From Table I it can be seen that aqueous lignosulfonate solutions form gels at high temperatures and the gellation times thereof decrease with increasing temperature.

The embodiments of the invention in which an exclusive property or privilege is claimd are defined as follows:

1. A method of thermally insulating a well bore containing a tubing string to reduce heat transfer between the well bore and surrounding formations comprising the steps of:

introducing a heat-activated gel-forming fluid having heat insulating properties when gelled between said well bore and tubing string; and causing said gel-forming fluid to be heated and thereby gelled.

2. The method of claim 1 wherein the step of causing said gel-forming fluid to be heated comprises flowing hot formation fluids through said tubing string by producing one or more formations penetrated by said well bore.

3. The method of claim 1 wherein the step of causing said gel-forming fluid to be heated comprises flowing a hot fluid from the surface through said tubing string and into one or more formations penetrated by said well bore.

4. The method of claim 3 wherein said hot fluid is hot water or steam.

5. The method of claim 4 wherein said heat-activated gel-forming fluid is selected from the group consisting of aqueous solutions of sodium lignosulfonate, ammonium lignosulfonate and mixtures of such lignosulfonates.

6. The method of claim 5 wherein said solution contains said lignosulfonates or mixture of lignosulfonates in an amount in the range of from about 5% to about 25% by weight of said solution.

7. The method of claim 6 wherein said heat activated gel-forming fluid is caused to be heated to a temperature in the range of from about 300° F. to about 600° F.

8. In a method of thermally insulating a well bore to reduce heat transfer between fluids flowing through a tubing string disposed in the well bore and formations surrounding the well bore wherein a heat insulating material is placed in the annular area between the well bore and tubing string, the improvement comprising the steps of:

introducing a heat-activated gel-forming fluid into said annular area between said well bore and tubing string, said gel-forming fluid having heat insulating properties when gelled; and heating said gel-forming fluid to a temperature whereby said gel-formed fluid is gelled.

9. The method of claim 8 wherein said heat activated gel-forming fluid is selected from the group consisting of aqueous solutions of sodium lignosulfonate, ammonium lignosulfonate and mixtures of such lignosulfonates.

10. The method of claim 9 wherein said solution contains said lignosulfonate or mixture of lignosulfonates in an amount in the range of from about 5% to about 25% by weight of said solution.

11. The method of claim 10 wherein the step of heating said gel-forming fluid is carried out by producing hot fluids from one or more formations penetrated by said well bore through said tubing string.

12. The method of claim 11 wherein the step of heating said gel-forming fluid is carried out by injecting a hot fluid from the surface into one or more formations penetrated by said well bore through said tubing string.

13. The method of claim 12 wherein said hot fluid has a temperature in the range of from about 300° F. to about 600° F.

14. The method of claim 13 wherein said hot fluid is selected from the group consisting of water, steam and mixtures thereof.

15. A method of thermally insulating a well bore containing a tubing string whereby the heat transfer between the well bore and surrounding formations is reduced comprising the steps of:

providing at least one enlarged portion on said tubing string above which the well bore is to be insulated, which enlarged portion restricts the flow of fluids therebelow in the annular space between the well bore and the tubing string;

introducing a heat-activated gel-forming fluid having heat insulating properties when gelled into the annular space between said well bore and tubing string above said enlarged portion on said tubing string; and heating said gel-forming fluid to thereby gel said fluid.

16. The method of claim 15 wherein said enlarged portion on said tubing string is of an outside radius which is less than the inside radius of said well bore by a distance in the range of from about 0.05 to about 0.5 inch.

17. The method of claim 16 wherein said tubing string includes a plurality of spaced-apart enlarged portions.

18. The method of claim 15 wherein the step of heating said gel-forming fluid comprises flowing hot formation fluids through said tubing string from one or more formations penetrated by said well bore to the surface.

19. The method of claim 15 wherein the step of heating said gel-forming fluid comprises flowing a hot fluid down through said tubing string into one or more formations penetrated by said well bore.

20. The method of claim 19 wherein said hot fluid is selected from the group consisting of water, steam and mixtures thereof.

21. The method of claim 15 wherein said heat-activated gel-forming fluid is selected from the group consisting of aqueous solutions of sodium lignosulfonate, ammonium lignosulfonate, and mixtures of such lignosulfonates.

22. The method of claim 21 wherein said solution contains said lignosulfonate or mixture of lignosulfonates in an amount in the range of from about 5% to about 25% by weight of said solution.

23. The method of claim 22 wherein said heat-activated gel-forming fluid is heated to a temperature in the range of from about 300° F. to about 600° F.

* * * * *